US007629102B2

(12) United States Patent
Ochi et al.

(10) Patent No.: US 7,629,102 B2
(45) **Date of Patent: *Dec. 8, 2009**

(54) METHOD FOR PREPARING ELECTROPHOTOGRAPHIC PHOTOSENSITIVE MEMBER

(75) Inventors: Atsushi Ochi, Numazu (JP); Harunobu Ogaki, Suntou-gun (JP); Kazunori Noguchi, Susono (JP); Hiroki Uematsu, Suntou-gun (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/025,399

(22) Filed: Feb. 4, 2008

(65) Prior Publication Data

US 2009/0023091 A1 Jan. 22, 2009

Related U.S. Application Data

(63) Continuation of application No. PCT/JP2007/068479, filed on Sep. 14, 2007.

(30) Foreign Application Priority Data

Jul. 17, 2007 (JP) ..... 2007-185406

(51) Int. Cl.
*G03G 5/00* (2006.01)

(52) U.S. Cl. ..... 430/127; 430/132

(58) Field of Classification Search ..... 430/127, 430/132

See application file for complete search history.

(56) References Cited

U.S. PATENT DOCUMENTS

| | | | | |
|---|---|---|---|---|
| 7,413,840 | B1 * | 8/2008 | Ogaki et al. | 430/132 |
| 2003/0215726 | A1 * | 11/2003 | Sugino et al. | 430/58.05 |
| 2004/0033428 | A1 * | 2/2004 | Niimi | 430/59.5 |
| 2004/0185358 | A1 * | 9/2004 | Kami | 430/58.7 |
| 2006/0134540 | A1 * | 6/2006 | Kondo et al. | 430/59.5 |
| 2007/0042281 | A1 * | 2/2007 | Orito et al. | 430/59.5 |
| 2007/0281239 | A1 | 12/2007 | Uematsu et al. | 430/133 |
| 2008/0019735 | A1 | 1/2008 | Ogaki et al. | 399/159 |

FOREIGN PATENT DOCUMENTS

AU B-74127/94 9/1994

(Continued)

*Primary Examiner*—Hoa V Le
(74) *Attorney, Agent, or Firm*—Fitzpatrick, Cella, Harper & Scinto

(57) ABSTRACT

A method for preparing in high productivity and stably an electrophotographic photosensitive member having depressed portions on its surface, is provided. The method is characterized in that a coating liquid for a surface layer which includes a solvent including a hydrophilic solvent and a hydrophobic solvent and a polymer compound soluble in the hydrophobic solvent is used; the hydrophilic solvent has a boiling point equal to or higher than that of the hydrophobic solvent; the hydrophilic solvent has a dipole moment of 0 or more and less than 2.8, obtained by a structure optimized calculation using a semiempirical molecular orbital calculation; the total mass of the hydrophobic solvent is 50 mass % or more and less than 100 mass % of the total mass of the solvent included in the coating liquid for a surface layer; and after the coating liquid for a surface layer is applied, the depressed portions are formed by condensation on the surface on which the coating liquid for a surface layer is applied.

10 Claims, 6 Drawing Sheets

FOREIGN PATENT DOCUMENTS

| | | |
|---|---|---|
| JP | 53092133 | 8/1978 |
| JP | 02-050850 | 2/1990 |
| JP | 02181152 | 7/1990 |
| JP | 07-097218 | 4/1995 |
| JP | 09227712 | 9/1997 |
| JP | 2000-010303 | 1/2000 |
| JP | 2001175008 | 6/2001 |
| JP | 2006070254 | 3/2006 |
| WO | 2006014009 A1 | 2/2006 |

* cited by examiner

METHOD FOR PREPARING ELECTROPHOTOGRAPHIC PHOTOSENSITIVE MEMBER

This application is a continuation of International Application No. PCT/JP2007/068479 filed on Sep. 14, 2007, which claims the benefit of Japanese Patent Application No. 2007-185406 filed on Jul. 17, 2007.

BACKGROUND OF THE INVENTION

1. Field of the Invention

The present invention relates to a method for preparing an electrophotographic photosensitive member.

2. Description of the Related Art

In recent years, electrophotographic photosensitive members using organic photoconductive substances, that is, organic electrophotographic photosensitive members have exhaustively been studied and developed from various view points.

Basically, electrophotographic photosensitive members include a supporting member and a photosensitive layer formed on the supporting member. A photosensitive layer included in an organic electrophotographic photosensitive member uses a charge generation material and a charge transport material as photoconductive materials, and a binder resin as a resin to bind these materials. The layer structure of a photosensitive layer involves a laminated structure in which the respective functions are separated into a charge generation layer and a charge transport layer, and a monolayer structure in which these materials are included in a monolayer. Electrophotographic photosensitive members often have a laminated structure which has a charge transport layer as a surface layer, but a surface protective layer is further provided on a charge transport layer in some cases.

Since the surface layer of an electrophotographic photosensitive member is a layer contacting with various members and recording media, the surface layer is required to have many functions such as mechanical strength and chemical stability, and various proposals have been made. For example, Japanese Patent Publication No. H07-97218 discloses a method in which grooves are formed on the surface of an electrophotographic photosensitive member by abrading the surface with a film-shaped abrasive. Japanese Patent Application Laid-Open No. H02-150850 discloses a method in which depressed portions are fabricated on the surface by sand blasting. Japanese Patent Publication No. H07-97218 and Japanese Patent Application Laid-Open No. H02-150850 are preparing methods necessitating an independent step for processing the surface of an electrophotographic photosensitive member. On the other hand, Japanese Patent Application Laid-Open No. S53-92133 discloses a case in which depressed portions are fabricated on the surface of an electrophotographic photosensitive member in the formation process of the surface layer of the electrophotographic photosensitive member. Japanese Patent Application Laid-Open No. 2000-10303 discloses a preparing method in which no liquid droplet traces are formed on the surface of an electrophotographic photosensitive member. The description of Japanese Patent Application Laid-Open No. 2000-10303 pointed out that dews condensate on the surface of an electrophotographic photosensitive member due to vaporization heat of a solvent during coating a photosensitive layer and condensation traces generated then are left as pores on the surface, causing factors of dark dots on images and toner filming. Japanese Patent Application Laid-Open No. 2001-175008 also discloses, like Japanese Patent Application Laid-Open No. 2000-10303, a preparing method of an electrophotographic photosensitive member which prevents whitening due to condensation.

SUMMARY OF THE INVENTION

Since methods described in Japanese Patent Publication No. H07-97218 and Japanese Patent Application Laid-Open No. H02-150850 necessitate an independent step of processing the surface of an electrophotographic photosensitive member, the preparing methods are not sufficient in view of productivity. Further, these methods have difficulties in providing uniformity over the entire processing region and in fine processing of the order of several micrometers, and are desired to be further improved in view of the functionality of the surface.

In Japanese Patent Application Laid-Open No S53-92133, since depressed portions are fabricated on the surface of an electrophotographic photosensitive member in a step of forming a surface layer of the electrophotographic photosensitive member, the method is excellent in view of productivity. Although the shape fabricated by this preparing method is indicated to have a gentle waveform and the method has an effect on improvement in the cleaning property and wear resistance, the method has a problem that fabrication of a fine waveform is difficult.

Japanese Patent Application Laid-Open No. 2000-10303 and Japanese Patent Application Laid-Open No 2001-175008 disclose preparing methods in which dews condensate on the surface of an electrophotographic photosensitive member due to vaporization heat of a solvent during coating a photosensitive layer and condensation traces generated then are not left as pores on the surface, and describe an advantage of the absence of formation of depressed portions on the surface. By contrast, Japanese Patent Application Laid-Open No. S53-92133 describes the functionality of formation of depressed portions on the surface. Therefore, the development of a preparing method of an electrophotographic photosensitive member having a suitable surface shape to improve the functionality is needed.

It is an object of the present invention to provide an excellent preparing method of an electrophotographic photosensitive member having depressed portions on the surface.

The present invention is a preparing method of an electrophotographic photosensitive member having depressed portions on the surface, characterized in that a coating liquid for a surface layer which includes a solvent including a hydrophilic solvent and a hydrophobic solvent and a polymer compound soluble in the hydrophobic solvent is used; the hydrophilic solvent has a boiling point equal to or higher than that of the hydrophobic solvent; the hydrophilic solvent has a dipole moment of 0 or more and less than 2.8, obtained by a structure optimized calculation using a semiempirical molecular orbital calculation; the total mass of the hydrophobic solvent is 50 mass % or more and less than 100 mass % of the total mass of the solvent included in the coating liquid for a surface layer; and after the coating liquid for a surface layer is applied, the depressed portions are formed by condensation on the surface on which the coating liquid for a surface layer is applied.

According to the present invention, a preparing method for preparing an electrophotographic photosensitive member having depressed portions on its surface in high productivity and stably can be provided.

Further features of the present invention will become apparent from the following description of exemplary embodiments with reference to the attached drawings.

DESCRIPTION OF THE EMBODIMENTS

Figure 1:
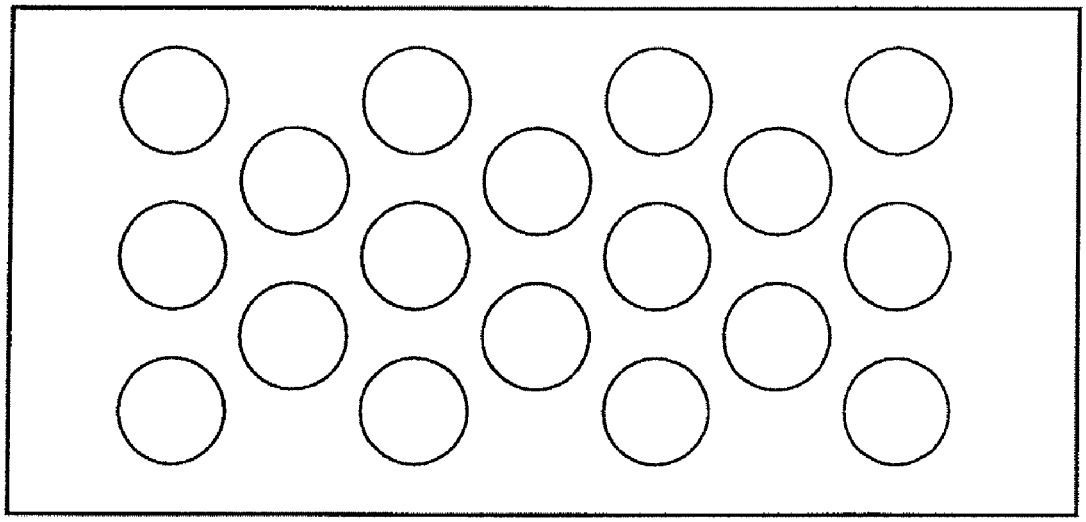
FIG. 1 illustrates a shape in the surface observation of depressed portions of the present invention.
Figure 2:
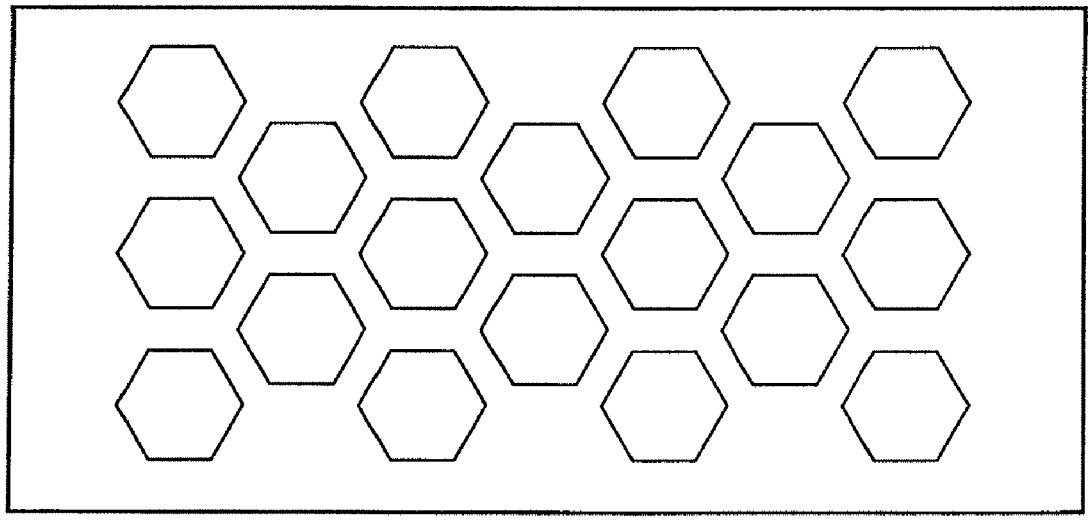
FIG. 2 illustrates a shape in the surface observation of depressed portions of the present invention.
Figure 3:
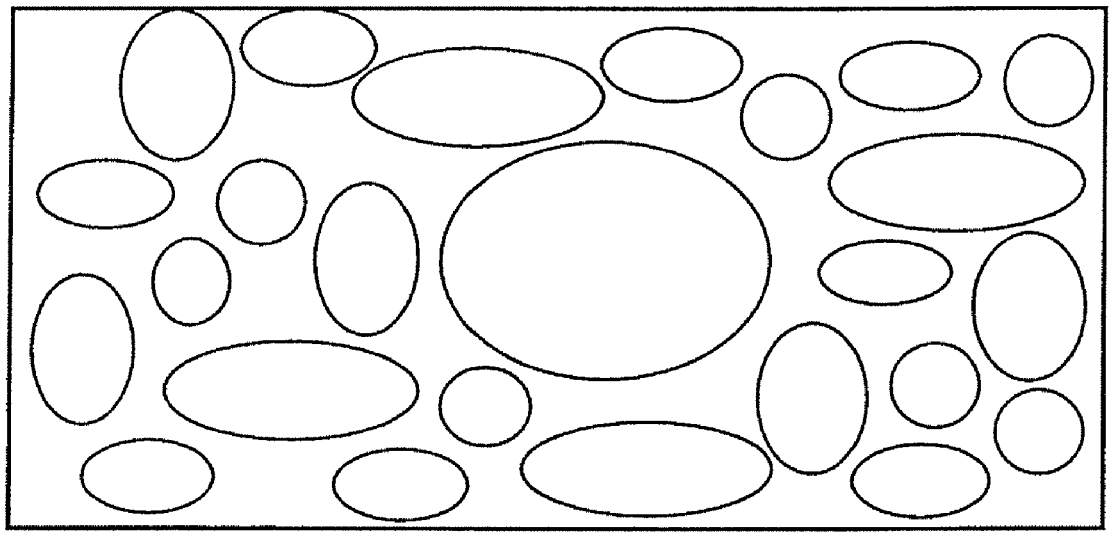
FIG. 3 illustrates a shape in the surface observation of depressed portions of the present invention.
Figure 4:
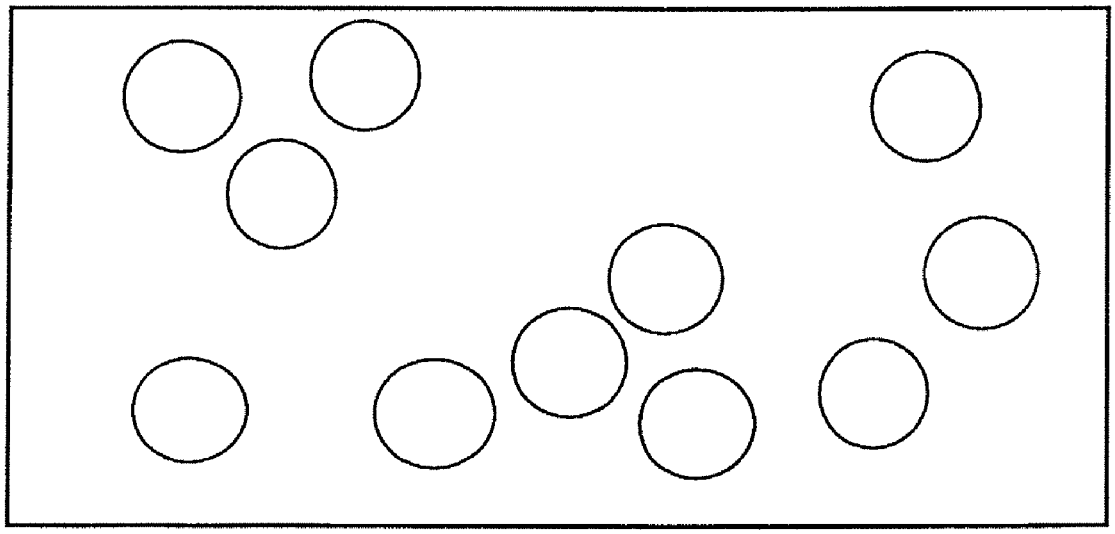
FIG. 4 illustrates a shape in the surface observation of depressed portions of the present invention.
Figure 5:
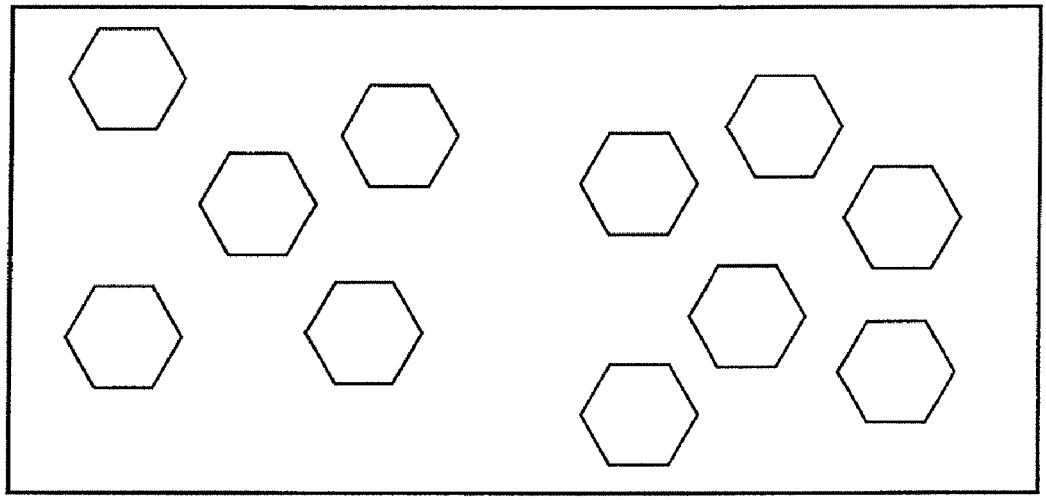
FIG. 5 illustrates a shape in the surface observation of depressed portions of the present invention.
Figure 6:
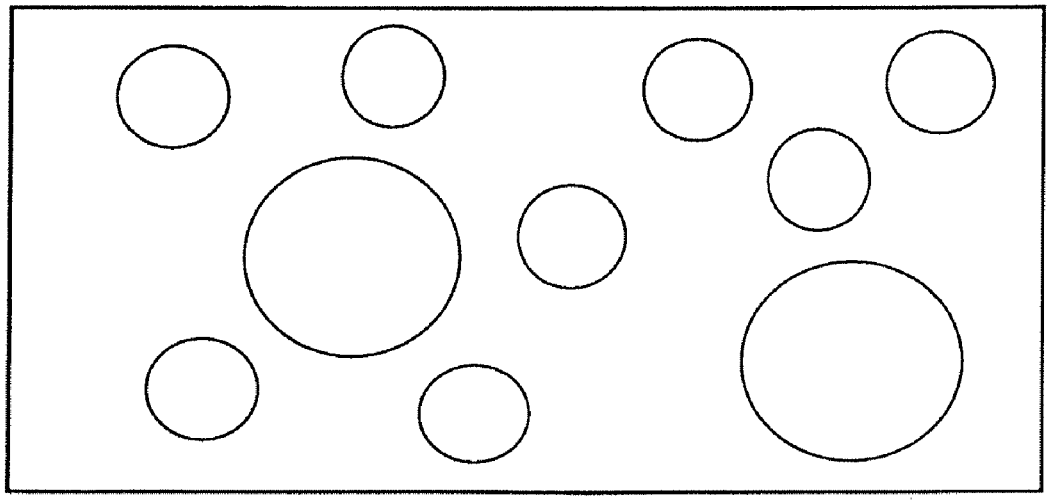
FIG. 6 illustrates a shape in the surface observation of depressed portions of the present invention.
Figure 7:
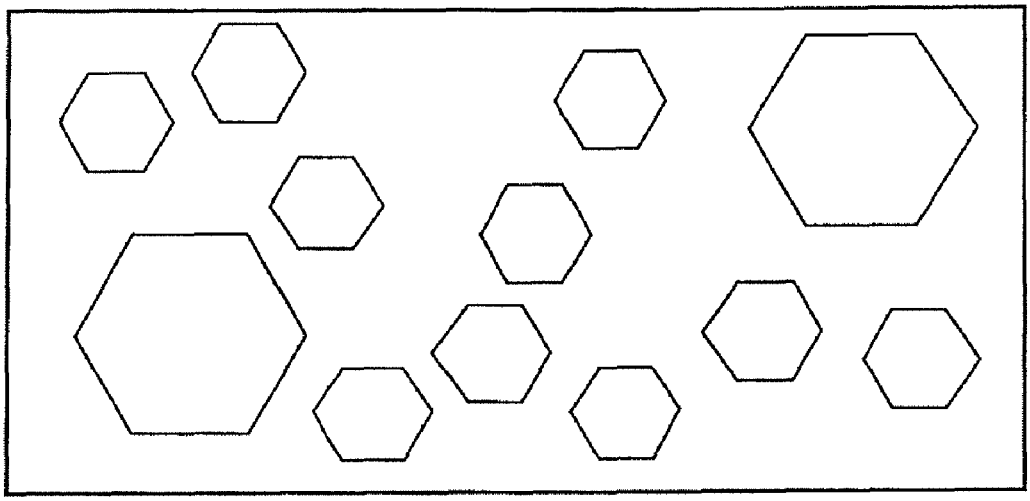
FIG. 7 illustrates a shape in the surface observation of depressed portions of the present invention.

Hereinafter, the present invention will be described in detail.

A hydrophilic solvent in the present invention refers to a solvent having a high affinity for water; and a hydrophobic solvent refers to a solvent having a low affinity for water. In the present invention, differentiation between a hydrophilic solvent and a hydrophobic solvent is based on the following experiment and determination standard.

(Experiment)

50 ml of water is charged in a 50-ml measuring cylinder at an ordinary temperature and ordinary humidity environment (23±3° C., 50±10% RH). Then, 50 ml of a solvent is charged in a 100-ml measuring cylinder, 50 ml of water measured in the previous operation is added, and fully stirred with a glass rod until the whole mixture becomes homogeneous. Further, the mixture is allowed to stand with a lid put so that the solvent and the water do not vaporize until air bubbles disappear and the interface stabilizes. Thereafter, the state of the mixed liquid in the 100-ml measuring cylinder is observed and the volume of the water phase is measured.

(Determination Standard)

When the water phase has a volume of not less than 0 ml and less than 5 ml, the solvent is classified as a hydrophilic solvent; and when the water phase has a volume of not less than 45 ml and not more than 50 ml, the solvent is classified as a hydrophobic solvent. When the mixed liquid has a homogeneous monolayer, the volume of the water phase is zero and the solvent is classified as a hydrophilic solvent. In the case of the volume out of this range, the solvent is not classified as a hydrophilic solvent nor as a hydrophobic solvent.

SPECIFIC EXAMPLES

In the above experiment, for example, when a solvent is toluene, the volume of the water phase is 50 ml, therefore, toluene is classified as a hydrophobic solvent. When a solvent is glycerol, the mixed liquid has a homogeneous monolayer and the volume of the water phase is zero, therefore, glycerol is classified as a hydrophilic solvent. When a solvent is 1,1-dimethoxymethane(methylal), the volume of the water phase is 69 ml, therefore, the solvent is not classified as a hydrophilic solvent nor as a hydrophobic solvent.

The dipole moment according to the structure optimized calculation using the semiempirical molecular orbital calculation in the present invention means a calculated value of a dipole moment calculated using a PM3 parameter set and using the semiempirical molecular orbital calculation program, MOPAC. In the molecular orbital method, a wave function used in the Shroedinger equation is approximated by a Slater determinant or a Gauss determinant composed of a molecular orbital expressed by a linear combination of atomic orbitals, and the molecular orbital constituting the wave function is determined using a field approximation. As a result, various physical quantities can be calculated as a total energy, a wave function and an expected value of a wave function.

A molecular orbital method in which when a molecular orbital is determined according to the field approximation, an integration calculation taking much calculating time uses parameters using various experimental values and are approximated to reduce the calculating time is the semiempirical molecular orbital method. The calculation in the present invention was conducted using a PM3 parameter set as semiempirical parameters and using a semiempirical molecular orbital calculation program, MOPAC.

Specifically, a work station, INDIGO2 (made by Silicon Graphics, Inc.) was used as a computer and a chemical calculation package software, Cerius2 was used for calculating the dipole moment. A molecular structure of a solvent of a calculation objective was made by the Skecher function in Cerius2; a force field calculation with respect to the molecular structure was conducted using DREDING2.21 program; and a charge calculation was conducted by the CHARGE function. Thereafter, the structure was optimized by a molecular force field calculation by Minimizer. A structural optimization and a dipole moment calculation of the structure thus obtained was conducted with PM3 parameters, Geometry Optimization and Dipole assigned to the MOPAC93 program and using a PM3 parameter set.

The affinity of a solvent and water has a relationship with the dipole moment; a hydrophilic solvent has a tendency of having a larger dipole moment; and a hydrophobic solvent has a tendency of having a smaller dipole moment. However, a solvent having a large dipole moment has a possibility of deteriorating electric characteristics of electrophotographic photosensitive members because of a large polarizability of the molecule. Therefore, a hydrophilic solvent in the present invention must have a dipole moment of 0 or more and less than 2.8.

A hydrophobic solvent in the present invention can have a dipole moment of 0 or more and 1.0 or less.

Hereinafter, representative examples of hydrophilic solvents and representative examples of hydrophobic solvents are shown, respectively, in Tables A1 to A4, and Table B, but the hydrophilic solvent and the hydrophobic solvent of the present invention are not limited thereto. The dipole moments in Tables A1 to A4 and Table B show calculated values of dipole moments calculated according to the above-mentioned method. The boiling points in Tables A1 to A4 and Table B show boiling points at atmospheric pressure as a rule, but in cases of boiling points at other than atmospheric pressure, the barometric pressure is separately described.

TABLE 1-1

Table A1: Representative examples of hydrophilic solvents

| No. | Name | Chemical formula | Boiling point [° C.] | Dipole moment [D] |
|---|---|---|---|---|
| A-1 | 1,2-ethanediol | $HOCH_2CH_2OH$ | 198 | 0.03 |
| A-2 | 1,2-propanediol | $CH_3CHOHCH_2OH$ | 187 | 0.1 |
| A-3 | 1,3-butanediol | $HOCH_2CH_2CHOHCH_3$ | 207 | 0.1 |
| A-4 | 1,4-butanediol | $HO(CH_2)_4OH$ | 229 | 0.01 |
| A-5 | Glycerol | $CH_2OH$<br>\|<br>$CHOH$<br>\|<br>$CH_2OH$ | 290 | 2.3 |
| A-6 | 1,2,6-hexanetriol | $CH_2OH$<br>\|<br>$CHCl'$<br>\|<br>$(CH_2)_3$<br>\|<br>$CH_2OEt$ | 178 (5 mmHg) | 2.2 |
| A-7 | Tetrahydrofuran | 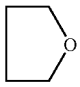 | 66 | 1.7 |
| A-8 | Diethylene glycol dimethyl ether | $CH_2CH_2OCH_3$<br>\|<br>$O$<br>\|<br>$CH_2CH_2OCH_3$ | 160 | 1.2 |
| A-9 | Diethylene glycol diethyl ether | $H_5C_2OC_2H_4—O—C_2H_4OC_2H_5$ | 188 | 1.1 |
| A-10 | Acetonylacetone | $H_2C—C(=O)—CH_2—CH_2—C(=O)—CH_3$ | 191 | 0.06 |
| A-11 | Propionic acid | $CH_3CH_2COOH$ | 141 | 1.8 |
| A-12 | Butyric acid | $CH_3CH_2CH_2COOH$ | 163 | 1.8 |
| A-13 | Diethylene glycol monoacetate | $H_3CCOOC_2H_4OC_2H_4OH$ | 139 (20 mmHg) | 1.6 |
| A-14 | Cyclohexylamine | 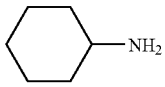 | 134 | 1.4 |
| A-15 | β-picoline | 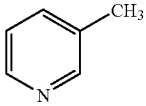 | 144 | 2.1 |

TABLE 1-2

Table A2: Representative examples of hydrophilic solvents

| No. | Name | Chemical formula | Boiling point [° C.] | Dipole moment [D] |
|---|---|---|---|---|
| A-16 | γ-picoline | 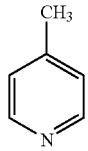 | 145 | 2.3 |
| A-17 | 2,4-lutidine | 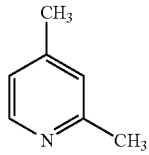 | 157 | 2.2 |
| A-18 | 2,6-lutidine | 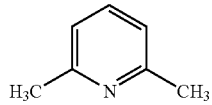 | 144 | 1.5 |
| A-19 | Quinoline | 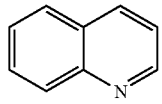 | 237 | 1.8 |
| A-20 | Diethylenetriamine | $H_2NCH_2CH_2NH$<br>$CH_2CH_2NH_2$ | 207 | 2.3 |
| A-21 | Tetraethylenepentamine | $H_2N(CH_2CH_2NH)_4H$ | 333 | 1.3 |
| A-22 | N,N,N',N'-tetramethylurea | $(GH_3)_3NCON(GH_3)_2$ | 177 | 2.4 |
| A-23 | 2-ethoxyethanol | $C_2H_5OCH_2CH_2OH$ | 136 | 0.03 |
| A-24 | 2-(methoxymethoxy) ethanol | $CH_2OCH_2OCH_3$<br>\|<br>$CH_2OH$ | 167 | 1.0 |
| A-25 | 2-isopropoxyethanol | $CH_3$<br>\|<br>$CH_2OCHCH_3$<br>\|<br>$CH_2OH$ | 140 | 0.3 |
| A-26 | 2-butoxyethanol | $CH_2OC_4H_9$<br>\|<br>$CH_2OH$ | 170 | 0.4 |
| A-27 | Furfuryl alcohol | 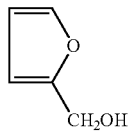 | 170 | 1.4 |
| A-28 | Tetrahydro furfuryl alcol | 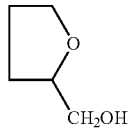 | 178 | 1.2 |
| A-29 | Diethylene glycol | $HOC_2H_4OC_2H_4OH$ | 245 | 1.2 |
| A-30 | Diethylene glycol monomethyl ether | $H_3CO(C_2H_4O)_2H$ | 194 | 1.5 |

TABLE 1-3

Table A3: Representative examples of hydrophilic solvents

| No. | Name | Chemical formula | Boiling point [° C.] | Dipole moment [D] |
|---|---|---|---|---|
| A-31 | Diethylene glycol monoethyl ether | $H_5G_2O(C_2H_4O)_2H$ | 202 | 1.6 |
| A-32 | Diethylene glycol monobutyl ether | $H_9C_4O(C_2H_4O)_2H$ | 230 | 1.6 |
| A-33 | Triethylene glycol | $HOC_2H_4OC_2H_4OC_2H_4OH$ | 288 | 0.03 |
| A-34 | Triethyelene glycol monomethyl ether | $H_3COC_2H_4OC_2H_4OC_2H_4OH$ | 249 | 0.2 |
| A-35 | Tetra-ethylene glycol | $HO(C_2H_4O)_4H$ | 327 | 1.7 |
| A-36 | Polyethylene glycol | $HO(CH_2CH_2O)_nH$ | Different depending on n | Different depending on n |
| A-37 | 1-ethoxy-2-propanol | $CH_3-CH(OH)-CH_2(OC_2H_5)$ | 132 | 2.6 |

TABLE 1-3-continued

Table A3: Representative examples of hydrophilic solvents

| No. | Name | Chemical formula | Boiling point [° C.] | Dipole moment [D] |
|---|---|---|---|---|
| A-41 | 2-(diethylamino) ethanol | $CH_3CH_2-N(CH_2CH_3)-CH_3-CH_2-OH$ | 162 | 0.9 |
| A-42 | N-butyl-diethanol amine | $C_4H_9N(CH_2CH_2OH)_2$ | 274 | 1.1 |
| A-43 | tri-ethanolamine | $N(CH_2CH_2OH)_3$ | 360 | 1.7 |
| A-44 | 2,2'-thio-diethanol | $S(CH_2CH_2OH)_2$ | 282 | 0.8 |
| A-45 | N-ethyl-morpholine | 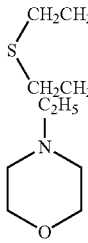 | 138 | 1.3 |

TABLE 1-4

Table A4: Representative examples of hydrophilic solvents

| No. | Name | Chemical formula | Boiling point [° C.] | Dipole moment [D] |
|---|---|---|---|---|
| A-46 | Diethylene glycol monoethyl ether acetate | $CH_3COOCH_2CH_2OCH_2CH_2OC_2H_5$ | 217 | 1.8 |
| A-47 | N,N,N',N'-tetramethyl ethylenediamine | $(CH_3)_2NCH_2CH_2N(CH_3)_2$ | 121 | 0.1 |

TABLE 1-3-continued

Table A3: Representative examples of hydrophilic solvents

| No. | Name | Chemical formula | Boiling point [° C.] | Dipole moment [D] |
|---|---|---|---|---|
| A-38 | Poly-propylene glycol | $H[OCH(CH_3)CH_2]_nOH$ | Different depending on n | Different depending on n |
| A-39 | 2-amino-ethanol | $H_2NCH_2CH_2OH$ | 171 | 1.1 |
| A-40 | 2-(dimethylamino) ethanol | $CH_3-N(CH_3)-CH_2-CH_2-OH$ | 135 | 0.8 |

TABLE 2

Table B: Representative examples of hydrophobic solvents

| No. | Name | Boiling point [° C.] | Dipole moment [D] |
|---|---|---|---|
| B-1 | Methylbenzene | 110 | 0.3 |
| B-2 | Ethylbenzene | 136 | 0.3 |
| B-3 | 1,2-dimethylbenzene | 144 | 0.5 |
| B-4 | 1,3-dimethylbenzene | 139 | 0.2 |
| B-5 | 1,4-dimethylbenzene | 138 | 0.1 |
| B-6 | 1,3,5-trimethylbenzene | 165 | 0.05 |
| B-7 | Chlorobenzene | 132 | 0.7 |
| B-8 | n-hexane | 69 | 0 |
| B-9 | Cyclohexane | 81 | 0 |
| B-10 | n-heptane | 98 | 0 |
| B-11 | Dichloromethane | 39 | 0.9 |
| B-12 | Chloroform | 62 | 1.0 |

A hydrophilic solvent in the present invention can be a compound having at least one of at least one functional group selected from the group consisting of a carbonyl group, a hydroxyl group and an amide group. Further, a hydrophilic solvent can be a compound having at least two of either one or both of a hydroxyl group and an amide group. Further, a hydrophilic solvent can be a polymer including either one or both of a hydroxyl group and an amide group as repeating structural units.

Among solvents described in Tables A1 to A4, hydrophilic solvents can be diethylene glycol diethyl ether, N,N,N',N'-tetramethylurea, 2-ethoxyethanol, 2-(methoxymethoxy) ethanol, 2-butoxyethanol, tetrahydrofurfuryl alcohol, diethylene glycol monomethyl ether, diethylene glycol monoethyl ether, triethylene glycol, polyethylene glycol and N,N,N',N'-tetramethylethylenediamine. Hydrophobic solvents in the present invention can be aromatic organic solvents. Among solvents described in Table B, hydrophobic solvents can be methylbenzene, ethylbenzene, 1,2-dimethylbenzene, 1,3-dimethylbenzene, 1,4-dimethylbenzene, 1,3,5-trimethylbenzene and chlorobenzene. These solvents may be used singly or as a mixture of two or more. That the hydrophilic solvent and the hydrophobic solvent have an affinity for each other and make a homogeneous solution, that is, be compatible with each other, is preferable for the preparing stability on manufacture of an electrophotographic photosensitive member having depressed portions on its surface.

Polymer compounds soluble in a hydrophobic solvent in the present invention are not especially limited as long as the polymer compounds are soluble in the hydrophobic solvent, and various polymer compounds can be selected depending on functional characteristics required as a surface layer of an electrophotographic photosensitive member. For example, acrylic resins, methacrylic resins, styrene resins, styrene acrylonitrile copolymerization resins, polyester resins, polycarbonate resins, polyarylate resins, polysulfone resins, polyphenylene oxide resins, epoxy resins, polyurethane resins, alkyd resins, unsaturated resins, conductive resins, aromatic polyester resins and diallylphthalate resins are preferable. Among these, polycarbonate resins and aromatic polyester resins are especially preferable in view of a favorable solubility to a hydrophobic solvent. These polymer compounds may be used singly or as a mixture of two or more.

The preparing method of the present invention involves applying a coating liquid for a surface layer including an above-mentioned hydrophilic solvent and an above-mentioned hydrophobic solvent and an above-mentioned polymer compound soluble in the hydrophobic solvent, and thereafter, forming depressed portions by condensation on the surface on which the coating liquid for a surface layer has been applied. Here, the condensation in the present invention means that moisture in the air condensates either on the surface on which the coating liquid for a surface layer is applied or inside thereof or on both.

The preparing method of the present invention is characterized by promoting condensation by using a hydrophilic solvent as a solvent of a coating liquid for a surface layer and controlling a solvent system of the coating liquid for a surface layer. The method has such a merit that depressed portions and their depth formed on the surface of an electrophotographic photosensitive member by condensation can be controlled depending on the kinds and amounts or a combination of hydrophilic solvents. The method has such large merits that utilization of a general-purpose solvent can reduce the cost, that the production stability is excellent because of a simple production method, and that no need for a special preparing apparatus results in an excellent versatility and a broad application possibility. Provided that for making the full use of the condensation promoting effect by a hydrophilic solvent in the evaporation process of solvents of the coating liquid for a surface layer, the hydrophilic solvent must has a boiling point equal to or higher than that of the hydrophobic solvent. In the case where this relation is not satisfied, since the hydrophilic solvent has evaporated before depressed portions are stably formed by condensation or since condensed water vaporizes as an azeotrope with the hydrophilic solvent, depressed portions may not possibly be formed. A hydrophobic solvent in the present invention can have a boiling point of 100° C. or higher.

In the preparing method of the present invention, for forming depressed portions on the surface of an electrophotographic photosensitive member by condensation, the total mass of hydrophobic solvents must be 50 mass % or more of the total mass of solvents included in the coating liquid for a surface layer. In the case of not satisfying this range, formation of depressed portions by condensation may possibly become difficult.

In the present invention, when a combination of two or more kinds of hydrophilic solvents is used, the boiling point of a solvent having a highest constituting proportion is defined as a boiling point of the hydrophilic solvents. Similarly, when a combination of two or more kinds of hydrophobic solvents is used, the boiling point of a solvent having a highest constituting proportion is defined as a boiling point of the hydrophobic solvents.

In the preparing method of the present invention, depending on functional characteristics required for the surface layer of an electrophotographic photosensitive member, the coating liquid for a surface layer can be applied by well-known methods such as bar coating, dip coating and spray coating.

In the preparing method of the present invention, for imparting functionalities as the surface layer of an electrophotographic photosensitive member, various substances, such as a charge generation material, a charge transport material, an antioxidant, an ultraviolet absorbent, a plasticizer, a crosslinking agent, metal fine particles, organic fine particles and a conductive compound, may be added. For control of the viscosity and dew point of the coating liquid for a surface layer, and the smoothness of the whole coating surface, adjustment of the dissolving power of a solvent system of the coating liquid for a surface layer, and control of the size and depth of holes on the surface of an electrophotographic photosensitive member, the kinds and amounts of hydrophilic solvents and hydrophobic solvents may be changed, or a combination of two or more kinds of solvents may be used. Various solvents other than hydrophilic solvents and hydrophobic solvents may be used. Further, adjustment processes of the temperature of the coating liquid for a surface layer, the temperature of a base on which the coating liquid for a surface layer is applied, and the temperature and humidity of the circumferential environment, and a process in which a high-humidity gas is sprayed on the surface on which the coating liquid for a surface layer is applied, may be combined.

Then, a structure of an electrophotographic photosensitive member according to the present invention will be described.

Figure 8:
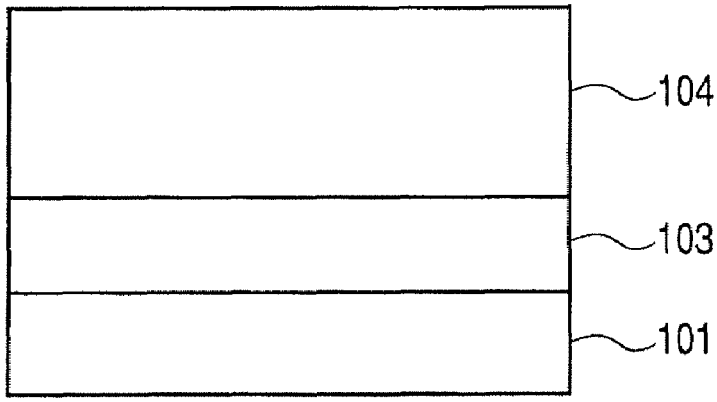
FIG. 8 illustrates an example of a layer structure of an electrophotographic photosensitive member according to the present invention.

As illustrated in FIGS. 8 to 12, electrophotographic photosensitive members of the present invention have an intermediate layer 103 and a photosensitive layer 104, in this order, on a cylindrical supporting member 101 (see FIG. 8).

Figure 9:
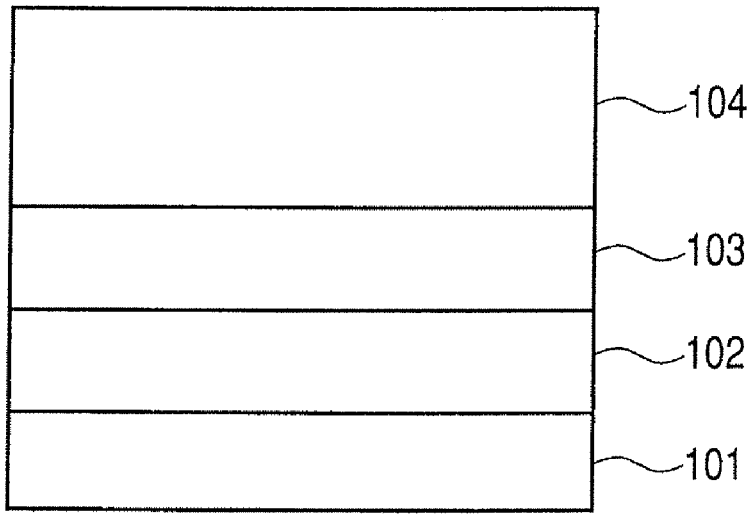
FIG. 9 illustrates an example of a layer structure of an electrophotographic photosensitive member according to the present invention.
Figure 10:
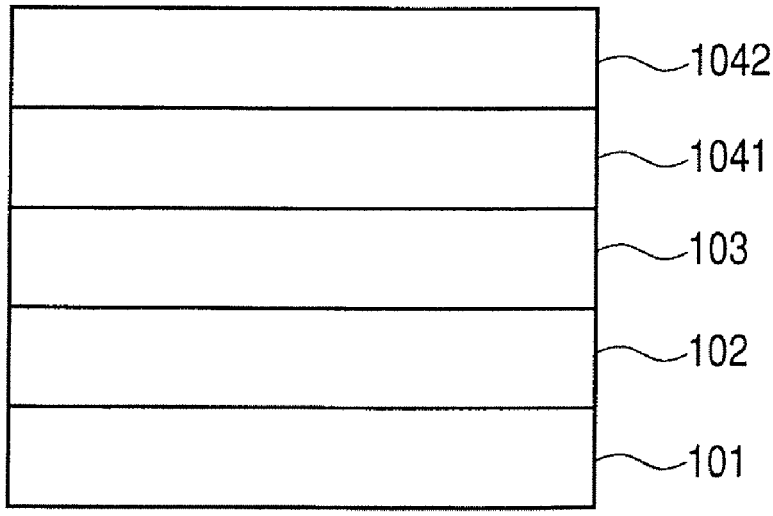
FIG. 10 illustrates an example of a layer structure of an electrophotographic photosensitive member according to the present invention.
Figure 11:
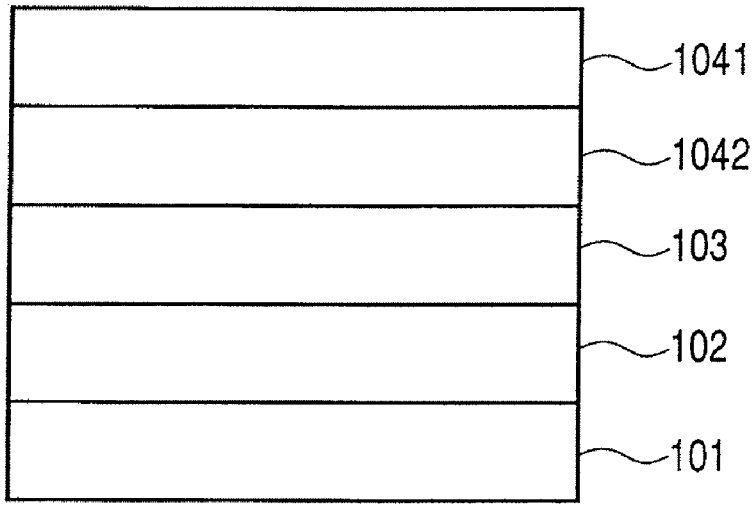
FIG. 11 illustrates an example of a layer structure of an electrophotographic photosensitive member according to the present invention.
Figure 12:
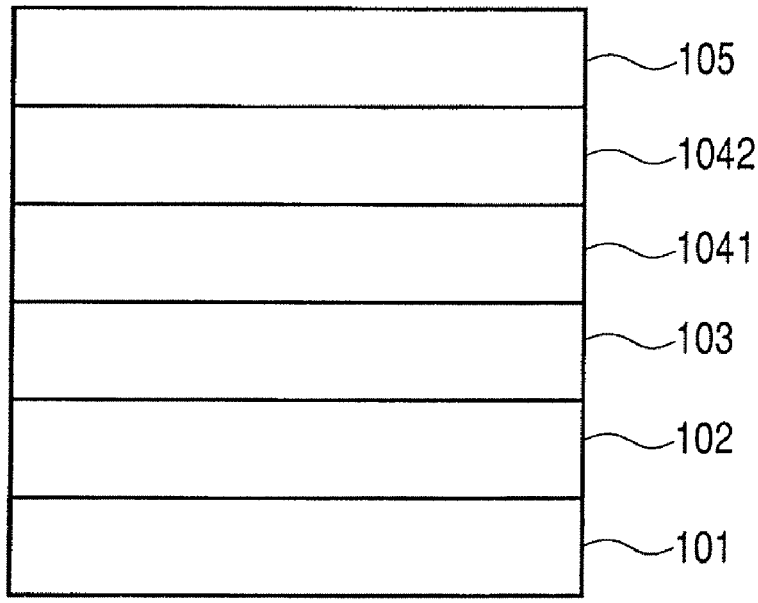
FIG. 12 illustrates an example of a layer structure of an electrophotographic photosensitive member according to the present invention.

As required, a conductive layer 102 whose volume resistance is reduced by dispersing conductive particles in a resin may be provided between a cylindrical supporting member 101 and an intermediate layer 103 (see FIG. 9). In this case, by making the film thickness of the conductive layer 102 thick, the layer may be made a layer to coat defects of the surface of a conductive cylindrical supporting member 101 or a nonconductive cylindrical supporting member 101 (for example, a resinous cylindrical supporting member).

A photosensitive layer may be a monolayer-type photosensitive layer 104 including a charge transport material and a charge generation material as one same layer (see FIG. 8) or a laminated-type (separated-function type) photosensitive layer separated into a charge generation layer 1041 including a charge generation material and a charge transport layer 1042 including a charge transport material. A laminated-type photosensitive layer may be used in view of electrophotographic characteristics. In the case of a monolayer-type photosensitive layer, the surface layer of the present invention is a photosensitive layer 104. For a laminated-type photosensitive layer, there is a regular-layer type photosensitive layer (see FIG. 10) in which a charge generation layer 1041 and a charge transport layer 1042 are laminated in this order from a cylindrical supporting member 101 side, or a reverse-layer type photosensitive layer (see FIG. 11) in which a charge transport layer 1042 and a charge generation layer 1041 are laminated in this order from a cylindrical supporting member 101 side. A regular-layer type photosensitive layer may be used in view of electrophotographic characteristics. In the case of a regular-layer type photosensitive layer among laminated-type photosensitive layers, the surface layer of the present invention is a charge transport layer; and in the case of a reverse-layer type photosensitive layer, the surface layer of the present invention is a charge generation layer.

A protective layer 105 (see FIG. 12) may be provided on a photosensitive layer 104 (a charge generation layer 1041, a charge transport layer 1042). In the case of having a protective layer 105, the surface layer of the present invention is the protective layer 105.

A cylindrical supporting member 101 can be that having conductivity (a conductive cylindrical supporting member), and a cylindrical supporting member made of, for example, a metal such as aluminum, an aluminum alloy or stainless steel can be used. In the case of aluminum or an aluminum alloy, ED pipes, EI pipes, those subjected to machining, electrolysis composite grinding (the electrolysis with electrodes and an electrolytic solution having the electrolytic action, and the grinding by a grindstone having the grinding action), or the wet or dry honing process, may be used. An above-mentioned metal-made cylindrical supporting member, or a resin-made cylindrical supporting member (polyethylene terephthalate, polybutylene terephthalate, phenol resin, polypropylene or polystyrene resin) having a layer formed by vacuum deposition of aluminum, an aluminum alloy or an indium oxide-tin oxide alloy, may be used. Further, a cylindrical supporting member in which a resin or a paper is impregnated with conductive particles such as carbon black, tin oxide particles, titanium oxide particles and silver particles, or a plastic having a conductive binder resin, may be used.

In the case of a conductive cylindrical supporting member whose surface is a layer provided to impart conductivity, the volume resistivity of the layer can be $1\times10^{10}$ Ω·cm or less, especially $1\times10^{6}$ Ω·cm or less.

On a conductive cylindrical supporting member, a conductive layer for coating scratches on the surface of the conductive cylindrical supporting member may be provided. This layer is a layer formed by applying a coating liquid in which a conductive powder is dispersed in a suitable binder resin.

Such a conductive powder includes the following: carbon black, acetylene black; metal powders such as aluminum, nickel, iron, nichrome, copper, zinc and silver; and metal oxide powders such as conductive tin oxide and ITO.

A binder resin simultaneously used includes the following thermoplastic resins, thermosetting resins and photocurable resins: polystyrenes, styrene-acrylonitrile copolymers, styrene-butadiene copolymers, styrene-maleic anhydride copolymers, polyesters, polyvinyl chlorides, vinyl chloride-vinyl acetate copolymers, polyvinyl acetates, polyvinylidene chlorides, polyarylate resins, phenoxy resins, polycarbonates, cellulose acetate resins, ethylcellulose resins, polyvinyl butyrals, polyvinyl formals, polyvinyl toluenes, poly-N-vinylcarbazoles, acrylic resins, silicone resins, epoxy resins, melamine resins, urethane resins, phenol resins and alkyd resins.

A conductive layer is formed by dispersing or dissolving an above-mentioned conductive powder and a binder resin in an ether solvent such as tetrahydrofuran and ethylene glycol dimethyl ether; an alcohol solvent such as methanol; a ketone solvent such as methyl ethyl ketone or an aromatic hydrocarbon such as methylbenzene, and applying the dispersion or solution. The conductive layer suitably has an average film thickness of 5 μm or more and 40 μm or less, suitably 10 μm or more and 30 μm or less.

On a conductive cylindrical supporting member or a conductive layer, an intermediate layer having a barrier function is provided.

The intermediate layer is formed by applying and then curing a curable resin to form a resin layer, or by applying a coating liquid for an intermediate layer including a binder resin on a conductive layer and drying the coating liquid.

A binder resin for an intermediate layer includes the following: water soluble resins such as polyvinyl alcohols, polyvinyl methyl ethers, polyacrylic acids, methylcelluloses, ethylcelluloses, polyglutamic acids and casein; and polyamide resins, polyimide resins, polyamide imide resins, polyamic acid resins, melamine resins, epoxy resins, polyurethane resins, and polyglutamate resins. A binder resin of an intermediate layer can be a thermoplastic resin in view of expressing effectively the electric barrier property and the coatability, adhesiveness, solvent resistance and electric resistance. Specifically, the binder resin may be a thermoplastic polyamide resin. The polyamide resin can be a copolymerized nylon of low crystallinity or non-crystallinity which can be applied in a solution state. An intermediate layer can have an average film thickness of 0.1 μm or more and 2.0 μm or less.

For making the flow of charges (carrier) not stagnant in an intermediate layer, semiconductive particles may be dispersed or an electron transport material (an electron-accepting material like an acceptor) may be included in the intermediate layer.

A photosensitive layer is provided on the intermediate layer.

A charge generation material used for the electrophotographic photosensitive member of the present invention includes the following: azo pigments such as monoazos, disazos and trisazos; phthalocyanine pigments such as metal phthalocyanines and nonmetal phthalocyanines; indigo pigments such as indigo and thioindigo; perylene pigments such as perylene acid anhydride and perylene acid imide; polycyclic quinone pigments such as anthraquinone and pyrenequinone; squalirium pigments, pyrylium salts, thiapyrylium salts and triphenylmethane pigments; inorganic materials such as selenium, selenium-tellurium and amorphous silicone; and quinacridone pigments, azulenium salt pigments, cyanine pigments, xanthene pigments, quinonimine pigments and styryl pigments. These charge generation materials may be used singly or in two or more thereof. Among these, metal phthalocyanines such as oxytitanium phthalocyanine, hydroxygallium phthalocyanine and chlorogallium phthalocyanine may be especially used because of their high sensitivity.

In the case where the photosensitive layer is a laminated-type photosensitive layer, a binder resin used for a charge generation layer includes the following: polycarbonate resins, polyester resins, polyarylate resins, butyral resins, polystyrene resins, polyvinyl acetal resins, diallyl phthalate resins, acrylic resins, methacrylic resins, vinyl acetate resins, phenol resins, silicone resins, polysulfone resins, styrene-butadiene copolymer resins, alkyd resins, epoxy resins, urea resins and vinyl chloride-vinyl acetate copolymer resins. Specifically, the binder resin may be butyral resins. These may be used singly or as a mixture thereof, or as one or more copolymers thereof.

The charge generation layer is formed by applying a coating liquid for a charge generation layer obtained by dispersing a charge generation material together with a binder resin and a solvent, and drying the coating liquid. Dispersing methods include methods using a homogenizer, ultrasound, ball mill, sand mill, attritor and roll mill. The proportion of a charge generation material and a binder resin can be in the range of 10:1 to 1:10 (mass ratio), especially in the range of 3:1 to 1:1 (mass ratio).

A solvent used for a coating liquid for a charge generation layer is selected from the dissolvabilities and dispersion stabilities of a binder resin and a charge generation material to be used. Organic solvents include alcohol solvents, sulfoxide solvents, ketone solvents, ether solvents, ester solvents and aromatic hydrocarbon solvents.

The charge generation layer can have an average film thickness of 5.0 μm or less, especially 0.1 μm or more and 2.0 μm or less.

Various sensitizers, antioxidants, ultraviolet absorbents and/or plastisizers may be optionally added to the charge generation layer. For making the flow of charges (carrier) in the charge generation layer not stagnant, an electron transport material (an electron-accepting material like an acceptor) may be included in the charge generation layer.

A charge transport material used for the electrophotographic photosensitive member of the present invention includes triarylamine compounds, hydrazone compounds, styryl compounds, stilbene compounds, pyrazoline compounds, oxazol compounds, thiazole compounds and triallylmethane compounds. These charge transport materials may be used singly or in two or more thereof.

The charge transport layer is formed by applying a coating liquid for a charge transport layer obtained by dissolving a charge transport material and a binder resin in a solvent and drying the coating liquid. The proportion of a charge transport material and a binder resin can be in the range of 2:1 to 1:2 (mass ratio).

In the case where the photosensitive layer is a monolayer-type photosensitive layer and a surface layer, an electrophotographic photosensitive member having depressed portions on its surface can be manufactured by applying a coating liquid for a surface layer for a monolayer-type photosensitive layer, wherein the coating liquid includes a solvent including an above-mentioned charge generation material, an above-mentioned charge transport material, an above-mentioned hydrophilic solvent and an above-mentioned hydrophobic solvent and including a polymer compound soluble in the hydrophobic solvent; the hydrophilic solvent has a boiling point equal to or higher than that of the hydrophobic solvent; the hydrophilic solvent has a dipole moment of 0 or more and less than 2.8, obtained by the structure optimized calculation using the semiempirical molecular orbital calculation; and the total mass of the hydrophobic solvent is 50 mass % or more and less than 100 mass % of the total mass of the solvents included in the coating liquid for a surface layer.

In the case where the photosensitive layer is a laminated-type photosensitive layer and the charge transport layer is a surface layer, an electrophotographic photosensitive member having depressed portions on its surface can be manufactured by applying a coating liquid for a surface layer for a laminated-type photosensitive layer, wherein the liquid includes a solvent including an above-mentioned charge transport material, an above-mentioned hydrophilic solvent and an above-mentioned hydrophobic solvent and including a polymer compound soluble in the hydrophobic solvent; the hydrophilic solvent has a boiling point equal to or higher than that of the hydrophobic solvent; the hydrophilic solvent has a dipole moment of 0 or more and less than 2.8, obtained by the structure optimized calculation using the semiempirical molecular orbital calculation; and the total mass of the hydrophobic solvent is 50 mass % or more and less than 100 mass % of the total mass of the solvents included in the coating liquid for a surface layer.

The charge transport layer can have an average film thickness of 5 μm or more and 40 μm or less, especially 10 μm or more and 30 μm or less.

In either of a monolayer-type photosensitive layer and a laminated-type photosensitive layer, a protective layer as a surface layer may be provided on the photosensitive layer. Also in this case, an electrophotographic photosensitive member having depressed portions on its surface can be manufactured by forming a protective layer by applying the coating liquid for a surface layer of the present invention. A protective layer may be provided for protecting the photosensitive layer.

The protective layer can have an average film thickness of 0.5 μm or more and 10 μm or less, especially 1.0 μm or more and 5.0 μm or less.

EXAMPLES

Hereinafter, the present invention will be further in detail described by way of specific examples However, the scope of the present invention is not limited thereto. "Parts" in examples means "parts by mass".

Example 1

An aluminum cylinder (JIS-A3003, ED pipe of an aluminum alloy, made by Showa Aluminum K.K.) of 260.5 mm in length and 30 mm in diameter, obtained by hot extrusion in an environment of 23° C. and 60%, was made to be a conductive cylindrical supporting member.

6.6 parts of $TiO_2$ particles as conductive particles coated with oxygen-deficiency type $SnO_2$ (powder resistivity: 80 Ω·cm, the coating ratio (mass ratio) of $SnO_2$: 50%), 5.5 parts of a phenol resin (trade name: Plyophen J-325, made by Dainippon Ink & Chemicals, Inc., the solid content: 60%) as a binder resin and 5.9 parts of methoxypropanol as a solvent were dispersed for 3 h by a sand mill using glass beads of 1 mm in diameter to prepare a dispersion.

The dispersion was added with 0.5 part of silicone resin particles (trade name: Tospearl 120, made by GE Toshiba Silicones Co., Ltd.) as a surface roughening material and 0.001 part of a silicone oil (trade name: SH28PA, made by Dow Corning Toray Co., Ltd.) as a leveling agent, and stirred to prepare a coating liquid for a conductive layer.

The coating liquid for a conductive layer was coated by immersion on the conductive cylindrical supporting member, dried at 140° C. for 30 min, and heat-cured to form a conductive layer whose average film thickness was 15 μm at a position of 130 mm from the upper end of the conductive cylindrical supporting member.

Further, a coating liquid for an intermediate layer obtained by dissolving 4 parts of an N-methoxymethylated nylon (trade name: Tresin EF-30T, made by Teikoku Chemical Ind. Co., Ltd.) and 2 parts of a copolymerized nylon resin (Amilan CM8000, made by Toray Ind, Inc.) in a mixed solvent of methanol 65-parts/n-butanol 30-parts, was coated by immersion on the conductive layer, and dried at a temperature of 100° C. for 10 min to form an intermediate layer whose average film thickness was 0.5 μm at a position of 130 mm from the upper end of the cylindrical supporting member.

Then, 10 parts of crystalline hydroxygallium phthalocyanine having strong peaks at 7.5°, 9.9°, 16.3°, 18.6°, 25.1° and 28.3° of Bragg angles (2θ±0.2°) in CuKα characteristic X-ray diffraction, 5 parts of a polyvinyl butyral (trade name: S-Lec BX-1, made by Sekisui Chemical Co., Ltd.) and 250 parts of cyclohexanone were dispersed in a sand mill apparatus using glass beads of 1 mm in diameter for 1 h, and added with 250 parts of ethyl acetate to prepare a coating liquid for a charge generation layer.

The coating liquid for a charge generation layer was coated by immersion on the intermediate layer, and dried at a temperature of 100° C. for 10 min to form a charge generation layer whose average film thickness was 0.16 μm at a position of 130 mm from the upper end of the cylindrical supporting member.

Then, 5.9 parts of a hydrophilic solvent (polyethylene glycol described at A-36 in Table A3, using Polyethylene Glycol 200 of Kishida Chemical Co., Ltd.), 32.3 parts of a hydrophobic solvent (chlorobenzene described at B-6 in Table B), 20.6 parts of dimethoxymethane as another solvent, 5.9 parts of a polymer compound (the polyarylate resin constituted of the repeating unit described at C-1 in Table C), 4.8 parts of a charge transport material (the compound described at D-1 in Table D) and 0.5 part of a charge transport material (the compound described at D-2 in Table D) were mixed and dissolved to prepare a coating liquid for a surface layer. The coating liquid for a surface layer was coated by immersion on the charge generation layer at an ordinary temperature and ordinary humidity environment (23° C., 50% RH). Thereafter, the coated layer was allowed to stand for 3 min at an ordinary temperature and ordinary humidity environment to form depressed portions on the coated layer surface. Further, the coated layer was put in an air-blowing drier which was heated to 120° C. in advance, and heat-dried for 1 h to form a charge transport layer whose average film thickness was 20 μm at a position of 130 mm from the upper end of the cylindrical supporting member to manufacture an electrophotographic photosensitive member having depressed portions on its surface. Observation of the surface of the electrophotographic photosensitive member thus manufactured by a laser microscope (VK-9500, made by Keyence Corp.) revealed the formation of a shape having a large number of holes regularly on its surface. These results are shown in Table E1. The diameter of the holes was about 10 μm; and the depth thereof was about 8 μm.

TABLE 3

Table C: Representative examples of polymer compounds

| No. | Repeating unit | Remarks |
|---|---|---|
| C-1 | 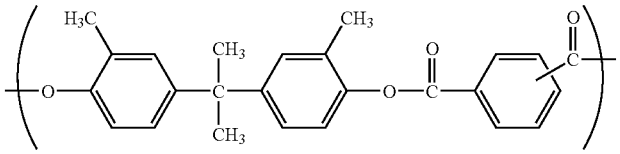 | Polyarylate resin Mw: 120000 The molar ratio of terephthalate structure to isophthalate structure is 50:50 |
| C-2 | 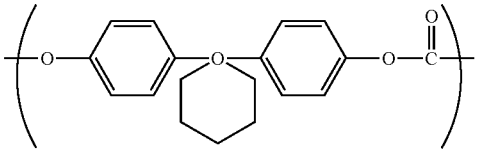 | Polycarbonate resin Mv: 20000 |
| C-3 | 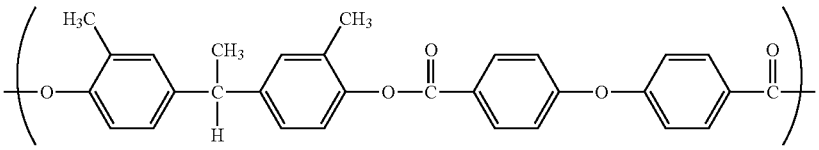 | Polyarylate resin Mw: 110000 |

TABLE 4

Table D: Representative examples of charge transport materials

| No. | Structural formula |
|---|---|
| D-1 | 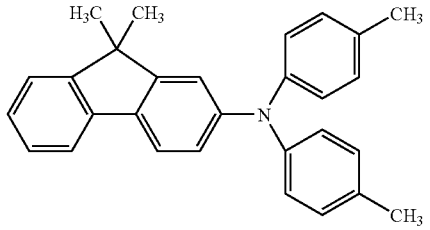 |
| D-2 | 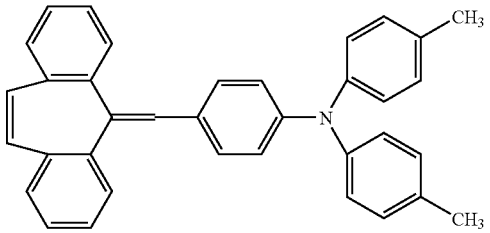 |

Example 2

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes regularly on its surface. The result is shown in Table E1. The diameter of the holes was about 8 μm; and the depth thereof was about 5 μm.

Example 3

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes regularly on its surface. The result is shown in Table E1. The diameter of the holes was about 6 μm; and the depth thereof was about 4 μm.

Example 4

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes on its surface. The result is shown in Table E1. The diameter of the holes was about 3 μm; and the depth thereof was about 2 μm.

Example 5

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes on its surface. The result is shown in Table E1. The diameter of the holes was about 2 μm; and the depth thereof was about 1 μm.

Example 6

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes regularly on its surface. The result is shown in Table E1. The diameter of the holes was about 7 μm; and the depth thereof was about 5 μm.

Example 7

Up to a charge generation layer was fabricated as in Example 1. Then, 5.9 parts of a hydrophilic solvent (2-ethoxyethanol described at A-23 in Table A2), 52.9 parts of a hydrophobic solvent (chlorobenzene described at B-6 in Table B), 11.8 parts of a polymer compound (the polycarbonate resin constituted of the repeating unit described at C-2 in Table C) and 10 parts of a charge transport material (the compound described at D-1 in Table D) were mixed and dissolved to prepare a coating liquid for a surface layer. The coating liquid for a surface layer was coated by immersion on the charge generation layer in an environment of 23° C. and 60% RH. Thereafter, the coated layer was allowed to stand for 5 min in an environment of 23° C. and 60% RH to form depressed portions on the coated layer surface. Further, the coated layer was put in an air-blowing drier which was heated to 120° C. in advance, and heat-dried for 1 h to form a charge transport layer whose average film thickness was 20 μm at a position of 130 mm from the upper end of the cylindrical supporting member to manufacture an electrophotographic photosensitive member having depressed portions on its surface. Observation of the surface of the electrophotographic photosensitive member thus manufactured was conducted as in Example 1 and revealed the formation of a shape having a large number of holes on its surface. The result is shown in Table E1.

Example 8

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes regularly on its surface. The result is shown in Table E1. The diameter of the holes was about 7 μm; and the depth thereof was about 5 μm.

Example 9

An electrophotographic photosensitive member was manufactured as in Example 1, except for alterations of the kinds and mass parts of materials for a coating liquid for a surface layer, coating environments, and a standing time after coating as described in Table E1, and observation of the surface revealed the formation of a shape having a large number of holes on its surface. The result is shown in Table E1.

Example 10

An electrophotographic photosensitive member was manufactured as in Example 7, except for alterations of the kinds and mass parts of materials for a coating liquid for a surface layer, coating environments, and a standing time after coating as described in Table E1, and observation of the surface revealed the formation of a shape having a large number of holes on its surface. The result is shown in Table E1.

Example 11

An electrophotographic photosensitive member was manufactured as in Example 7, except for alterations of the kinds and mass parts of materials for a coating liquid for a surface layer, coating environments, and a standing time after coating as described in Table E2, and observation of the surface revealed the formation of a shape having a large number of holes on its surface. The result is shown in Table E2.

Example 12

An electrophotographic photosensitive member was manufactured as in Example 1, except for alterations of the kinds and mass parts of materials for a coating liquid for a surface layer, coating environments, and a standing time after coating as described in Table E2, and observation of the surface revealed the formation of a shape having a large number of holes regularly on its surface. The result is shown in Table E2. The diameter of the holes was about 3 μm; and the depth thereof was about 2 μm.

Example 13

An electrophotographic photosensitive member was manufactured as in Example 7, except for alterations of the kinds and mass parts of materials for a coating liquid for a surface layer, coating environments, and a standing time after coating as described in Table E2, and observation of the surface revealed the formation of a shape having a large number of holes on its surface. The result is shown in Table E2.

Example 14

An electrophotographic photosensitive member was manufactured as in Example 1, except for alterations of the kinds and mass parts of materials for a coating liquid for a surface layer, coating environments, and a standing time after coating as described in Table E2, and observation of the surface revealed the formation of a shape having a large number of holes on its surface. The result is shown in Table E2.

Example 15

An electrophotographic photosensitive member was manufactured as in Example 1, except for alterations of the kinds and mass parts of materials for a coating liquid for a surface layer, coating environments, and a standing time after coating as described in Table E2, and observation of the surface revealed the formation of a shape having a large number of holes on its surface. The result is shown in Table E2.

Example 16

An electrophotographic photosensitive member was manufactured as in Example 7, except for alterations of the kinds and mass parts of materials for a coating liquid for a surface layer, coating environments, and a standing time after coating as described in Table E2, and observation of the surface revealed the formation of a shape having a large number of holes on its surface. The result is shown in Table E2.

Example 17

An electrophotographic photosensitive member was manufactured as in Example 1, except for alterations of the kinds and mass parts of materials for a coating liquid for a surface layer, coating environments, and a standing time after coating as described in Table E2, and observation of the surface revealed the formation of a shape having a large number of holes regularly on its surface. The result is shown in Table E2. The diameter of the holes was about 6 μm; and the depth thereof was about 4 μm.

Example 18

An electrophotographic photosensitive member was manufactured as in Example 7, except for alterations of the kinds and mass parts of materials for a coating liquid for a surface layer, coating environments, and a standing time after coating as described in Table E2, and observation of the surface revealed the formation of a shape having a large number of holes regularly on its surface. The result is shown in Table E2. The diameter of the holes was about 8 μm; and the depth thereof was about 6 μm.

Example 19

An electrophotographic photosensitive member was manufactured as in Example 1, except for alterations of the kinds and mass parts of materials for a coating liquid for a surface layer, coating environments, and a standing time after coating as described in Table E2, and observation of the surface revealed the formation of a shape having a large number of holes regularly on its surface. The result is shown in Table E2. The diameter of the holes was about 4 μm; and the depth thereof was about 3 μm.

Example 20

An electrophotographic photosensitive member was manufactured as in Example 1, except for alterations of the kinds and mass parts of materials for a coating liquid for a surface layer, coating environments, and a standing time after coating as described in Table E2, and observation of the surface revealed the formation of a shape having a large number of holes on its surface. The result is shown in Table E2.

The hydrophilic solvent of Example 6 was the polyethylene glycol described at A-36 in Table A3, i.e., Polyethylene Glycol 300 made by Kishida Chemical Co., Ltd. Xylene used as a hydrophobic solvent in Examples 18 and 19, and Comparative Examples 9 and 10, which will be described hereinafter, was a mixture of 1,2-dimethylbenzene (21.7%), 1,3-dimethylbenzene (44.2%), 1,4-dimethylbenzene (18.7%) and ethylbenzene (15.4%), and therefore, the boiling point (139° C.) and the dipole moment (0.2D) of 1,3-dimethylbenzene, which had a highest component ratio among them, were adopted as a boiling point and a dipole moment of xylene.

Comparative Examples 1 to 3, Comparative Example 5, Comparative Example 7 and Comparative Example 9

Electrophotographic photosensitive members were manufactured as in Example 1, except for alterations of the kinds and mass parts of materials for a coating liquid for a surface layer, coating environments, and a standing time after coating as described in Table E3, and observation of the surfaces revealed no formation of depressed portions on their surfaces. These results are shown in Table E3.

Comparative Example 4, Comparative Example 6, Comparative Example 8 and Comparative Example 10

Electrophotographic photosensitive members were manufactured as in Example 7, except for alterations of the kinds and mass parts of materials for a coating liquid for a surface layer, coating environments, and a standing time after coating as described in Table E3, and observation of the surfaces revealed no formation of depressed portions on their surfaces. These results are shown in Table E3.

Comparative Example 11

Up to a charge generation layer was fabricated as in Example 1. Then, 1.7 parts of a hydrophilic solvent (the polyethylene glycol described at A-36 in Table A3, using Polyethylene Glycol 200 of Kishida Chemical Co., Ltd.), 57.1 parts of a hydrophilic solvent (tetrahydrofuran described at A-7 in Table A1), 5.9 parts of a polymer compound (the polyarylate resin constituted of the repeating unit described at C-1 in Table C), 4.8 parts of a charge transport material (the compound described at D-1 in Table D) and 0.5 part of a charge transport material (the compound described at D-2 in Table D) were mixed and dissolved to prepare a coating liquid for a surface layer. The coating liquid for a surface layer was coated by immersion on the charge generation layer at an ordinary temperature and ordinary humidity environment (23° C., 50% RH). Thereafter, the coated layer was allowed to stand for 3 min at an ordinary temperature and ordinary humidity environment. Further, the coated layer was put in an air-blowing drier which was heated to 120° C. in advance, and heat-dried for 1 h to form a charge transport layer whose average film thickness was 20 μm at a position of 130 mm from the upper end of the cylindrical supporting member. Observation of the surface of the electrophotographic photosensitive member thus manufactured by a laser microscope (VK-9500, made by Keyence Corp.) revealed no formation of depressed portions on its surface.

Comparative Example 12

Up to a charge generation layer was fabricated as in Example 1. Then, 1.7 parts of a hydrophilic solvent (the polyethylene glycol described at A-36 in Table A3, using Polyethylene Glycol 200 of Kishida Chemical Co., Ltd.), 57.1 parts of a hydrophilic solvent (tetrahydrofuran described at A-7 in Table A1), 11.8 parts of a polymer compound (the polycarbonate resin constituted of the repeating unit described at C-2 in Table C) and 10 parts of a charge transport material (the compound described at D-1 in Table D) were mixed and dissolved to prepare a coating liquid for a surface layer. The coating liquid for a surface layer was coated by immersion on the charge generation layer at an ordinary temperature and ordinary humidity environment (23° C., 50% RH). Thereafter, the coated layer was allowed to stand for 3 min at an ordinary temperature and ordinary humidity environment. Further, the coated layer was put in an air-blowing drier which was heated to 120° C. in advance, and heat-dried for 1 h to form a charge transport layer whose average film thickness was 20 μm at a position of 130 mm from the upper end of the cylindrical supporting member. Observation of the surface of the electrophotographic photosensitive member thus manufactured by a laser microscope (VK-9500, made by Keyence Corp.) revealed no formation of depressed portions on its surface.

The viscosity-average molecular weight (Mv) and the weight-average molecular weight (Mw) of a polymer compound in the present invention were measured according to the following methods.

(Measurement Method of Viscosity-average Molecular Weight (Mv))

First, 0.5 g of a sample was dissolved in 100 ml of methylene chloride, and the specific viscosity at 25° C. was measured using a modified Ubbelohde-type viscosimeter. Then, the limiting viscosity was determined from the specific viscosity; and the viscosity-average molecular weight (Mv) was calculated from the Mark-Houwink viscosity formula. The viscosity-average molecular weight (Mv) was adopted as a polystyrene conversion measured by GPC (gel permeation chromatography).

(Measurement Method of Weight-average Molecular Weight)

A measuring object resin was charged in tetrahydrofuran, allowed to stand for several hours, and thereafter, the measuring object resin and the tetrahydrofuran were fully mixed while being shaked (mixed till agglomerates of the measuring object resin disappear), and further allowed to stand for more than 12 h.

Thereafter, a solution obtained by passing the measuring mixture through a sample-treating filter, Myshori Disk H-25-5, made by Tosoh Corp., was adopted as a sample for GPC (gel permeation chromatography).

Then, the column was stabilized in a heat chamber of 40° C.; tetrahydrofuran as a solvent was made to flow through the column of this temperature at a flow rate of 1 ml/min; and 10 μl of the sample for GPC was injected therein to measure the weight-average molecular weight of the measuring object resin. As the column, a column, TSKgel SuperHM-M, made by Tosoh Corp., was used.

In measurement of the weight-average molecular weight of the measuring object resin, the molecular weight distribution of the measuring object resin to be measured was calculated from a relation between logarithms and count numbers of a calibration curve prepared using several kinds of monodisperse polystyrene standard samples. As the standard polystyrene samples for preparing the calibration curve, ten kinds of monodisperse polystyrene, made by Sigma-Aldrich Co., whose molecular weights were 3,500, 12,000, 40,000, 75,000, 98,000, 120,000, 240,000, 500,000, 800,000 and 1,800,000, were used. As a detector, an RI (refraction index) detector was used.

(Table 5-1)

TABLE E1

| No. | Hydrophilic solvent<br>Dipole moment<br>Boiling point | Parts by mass | Hydrophobic solvent<br>Dipole moment<br>Boiling point | Parts by mass | Other solvent<br>Dipole moment<br>Boiling point | Parts by mass | Polymer compound<br>No. of Table C | Parts by mass | Remarks Coating environment Standing time, etc. |
|---|---|---|---|---|---|---|---|---|---|
| Ex. 1 | Polyethylene Glycol 200<br>1.5 [D]<br>250 [° C.] | 5.9 | Chlorobenzene<br>0.953 [D]<br>131.7 [° C.] | 32.3 | Dimethoxymethane<br>2.4 [D]<br>42.3 [° C.] | 20.6 | Polyarylate resin<br>C-1 | 5.9 | 23° C. 50% RH For 3 min Formation of depressed portions |
| Ex. 2 | Polyethylene Glycol 200<br>1.5 [D]<br>250 [° C.] | 2.9 | Chlorobenzene<br>0.953 [D]<br>131.7 [° C.] | 35.3 | Dimethoxymethane<br>2.4 [D]<br>42.3 [° C.] | 20.6 | Polyarylate resin<br>C-1 | 5.9 | 23° C. 50% RH For 3 min Formation of depressed portions |
| Ex. 3 | Polyethylene Glycol 200<br>1.5 [D]<br>250 [° C.] | 1.7 | Chlorobenzene<br>0.953 [D]<br>131.7 [° C.] | 36.5 | Dimethoxymethane<br>2.4 [D]<br>42.3 [° C.] | 20.6 | Polyarylate resin<br>C-1 | 5.9 | 23° C. 50% RH For 3 min Formation of depressed portions |
| Ex. 4 | Polyethylene Glycol 200<br>1.5 [D]<br>250 [° C.] | 0.6 | Chlorobenzene<br>0.953 [0]<br>131.7 [° C.] | 37.6 | Dimethoxymethane<br>2.4 [D]<br>42.3 [° C.] | 20.6 | Polyarylate resin<br>C-1 | 5.9 | 23° C. 50% RH For 3 min Formation of depressed portions |
| Ex. 5 | Polyethylene Glycol 200<br>1.5 [D]<br>250 [° C.] | 0.3 | Chlorobenzene<br>0.953 [D]<br>131.7 [° C.] | 37.9 | Dimethoxymethane<br>2.4 [D]<br>42.3 [° C.] | 20.6 | Polyarylate resin<br>C-1 | 5.9 | 23° C. 50% RH For 3 min Formation of depressed portions |
| Ex. 6 | Polyethylene Glycol 300<br>1.3 [D]<br>305 [° C.] | 2.9 | Chlorobenzene<br>0.953 [D]<br>131.7 [° C.] | 35.3 | Dimethoxymethane<br>2.4 [D]<br>42.3 [° C.] | 20.6 | Polyarylate resin<br>C-1 | 5.9 | 23° C. 50% RH For 1 min Formation of depressed portions |
| Ex. 7 | 2-ethoxyethanol<br>0.03 [D]<br>136 [° C.] | 5.9 | Chlorobenzene<br>0.953 [D]<br>131.7 [° C.] | 52.9 | —<br>— | — | Polycarbonate resin<br>C-2 | 11.8 | 23° C. 60% RH For 5 min Formation of depressed portions |
| Ex. 8 | Triethylene glycol<br>0.03 [D]<br>288 [° C.] | 1.7 | Chlorobenzene<br>0.953 [D]<br>131.7 [° C.] | 45.3 | Dimethoxymethane<br>2.4 [D]<br>42.3 [° C.] | 11.8 | Polyarylate resin<br>C-1 | 5.9 | 23° C. 40% RH For 1 min Formation of depressed portions |
| Ex. 9 | 2-butoxyethanol<br>0.4 [D]<br>170 [° C.] | 2.9 | Chlorobenzene<br>0.953 [D]<br>131.7 [° C.] | 35.3 | Dimethoxymethane<br>2.4 [D]<br>42.3 [° C.] | 20.6 | Polyarylate resin<br>C-1 | 5.9 | 23° C. 50% RH For 3 min Formation of depressed portions |
| Ex. 10 | 2-(methoxymethoxy)ethanol<br>1.0 [D]<br>167 [° C.] | 5.9 | Chlorobenzene<br>0.953 [D]<br>131.7 [° C.] | 32.9 | —<br>— | — | Polycarbonate resin<br>C-2 | 11.8 | 23° C. 65% RH For 10 min Formation of depressed portions |

(Table 5-2)

TABLE E2

| No. | Hydrophilic solvent<br>Dipole moment<br>Boiling point | Parts by mass | Hydrophobic solvent<br>Dipole moment<br>Boiling point | Parts by mass | Other solvent<br>Dipole moment<br>Boiling point | Parts by mass | Polymer compound<br>No. of Table C | Parts by mass | Remarks Coating environment Standing time, etc. |
|---|---|---|---|---|---|---|---|---|---|
| Ex. 11 | Diethylene glycol diethyl ether<br>1.1 [D]<br>188 [° C.] | 2.9 | Chlorobenzene<br>0.953 [D]<br>131.7 [° C.] | 55.9 | —<br>— | — | Polycarbonate resin<br>C-2 | 11.8 | 30° C. 50% RH For 3 min Formation of depressed portions |

TABLE E2-continued

| No. | Hydrophilic solvent<br>Dipole moment<br>Boiling point | Parts by mass | Hydrophobic solvent<br>Dipole moment<br>Boiling point | Parts by mass | Other solvent<br>Dipole moment<br>Boiling point | Parts by mass | Polymer compound<br>No. of Table C | Parts by mass | Remarks Coating environment Standing time, etc. |
|---|---|---|---|---|---|---|---|---|---|
| Ex. 12 | Tetrahydrofurfuryl alcohol<br>1.2 [D]<br>178 [° C.] | 1.7 | Chlorobenzene<br>0.953 [D]<br>131.7 [° C.] | 51.2 | Dimethoxymethane<br>2.4 [D]<br>42.3 [° C.] | 5.9 | Polyarylate resin<br>C-1 | 5.9 | 25° C. 45% RH For 3 min Formation of depressed portions |
| Ex. 13 | Diethylene glycol monomethyl ether<br>1.5 [D]<br>194 [° C.] | 1.8 | Chlorobenzene<br>0.953 [D]<br>131.7 [° C.] | 33.5 | Dimethoxymethane<br>2.4 [D]<br>42.3 [° C.] | 23.5 | Polycarbonate resin<br>C-2 | 11.8 | 20° C. 50% RH For 3 min Formation of depressed portions |
| Ex. 14 | Diethylene glycol monoethyl ether<br>1.6 [D]<br>202 [° C.] | 2.9 | Chlorobenzene<br>0.953 [D]<br>131.7 [° C.] | 55.9 | —<br>— | — | Polyarylate resin<br>C-1 | 5.9 | 23° C. 50% RH For 3 min Formation of depressed portions |
| Ex. 15 | N,N,N',N'-tetramethylurea<br>2.4 [D]<br>177 [° C.] | 5.9 | Chlorobenzene<br>0.953 [D]<br>131.7 [° C.] | 52.9 | —<br>— | — | Polyarylate resin<br>C-1 | 5.9 | 25° C. 60% RH For 3 min Formation of depressed portions |
| Ex. 16 | N,N,N',N'-tetramethylethylenediamine<br>0.1 [D]<br>121 [° C.] | 2.9 | Methylbenzene<br>0.261 [D]<br>110.6 [° C.] | 35.3 | Dimethoxymethane<br>2.4 [D]<br>42.3 [° C.] | 20.6 | Polycarbonate resin<br>C-2 | 11.8 | 23° C. 50% RH For 3 min Formation of depressed portions |
| Ex. 17 | Polyethylene Glycol 200<br>1.5 [D]<br>250 [° C.] | 1.8 | Methylbenzene<br>0.261 [D]<br>110.6 [° C.] | 57.0 | —<br>— | — | Polyarylate resin<br>C-3 | 5.9 | 20° C. 40% RH For 3 min Formation of depressed portions |
| Ex. 18 | Triethylene glycol<br>0.03 [D]<br>288 [° C.] | 3.0 | Xylene<br>0.24 [D]<br>139 [° C.] | 52.9 | Dimethoxymethane<br>2.4 [D]<br>42.3 [° C.] | 2.9 | Polycarbonate resin<br>C-2 | 11.8 | 25° C. 55% RH For 3 min Formation of depressed portions |
| Ex. 19 | Tetrahydrofurfuryl alcohol<br>1.2 [D]<br>178 [° C.] | 3.0 | Xylene<br>0.24 [D]<br>139 [° C.] | 55.8 | —<br>— | — | Polyarylate resin<br>C-3 | 5.9 | 23° C. 50% RH For 3 min Formation of depressed portions |
| Ex. 20 | N,N,N',N'-tetramethylurea<br>2.4 [D]<br>177 [° C.] | 2.9 | 1,3,5-trimethylbenzene<br>0.12 [D]<br>165 [° C.] | 29.4 | Dimethoxymethane<br>2.4 [D]<br>42.3 [° C.] | 26.5 | Polyarylate resin<br>C-3 | 5.9 | 23° C. 50% RH For 3 min Formation of depressed portions |

(Table 5-3)

TABLE E3

| No. | Hydrophilic solvent<br>Dipole moment<br>Boiling point | Parts by mass | Hydrophobic solvent<br>Dipole moment<br>Boiling point | Parts by mass | Other solvent<br>Dipole moment<br>Boiling point | Parts by mass | Polymer compound<br>No. of Table C | Parts by mass | Remarks Coating environment Standing time, etc. |
|---|---|---|---|---|---|---|---|---|---|
| Com. Ex. 1 | —<br>— | — | Chlorobenzene<br>0.953 [D]<br>131.7 [° C.] | 32.3 | Dimethoxymethane<br>2.4 [D]<br>42.3 [° C.] | 26.5 | Polyarylate resin<br>C-1 | 5.9 | 23° C. 50% RH For 3 min No depressed portion |
| Com. Ex. 2 | —<br>— | — | Chlorobenzene<br>0.953 [D]<br>131.7 [° C.] | 47.0 | Dimethoxymethane<br>2.4 [D]<br>42.3 [° C.] | 11.8 | Polyarylate resin<br>C-1 | 5.9 | 23° C. 50% RH For 3 min No depressed portion |

TABLE E3-continued

| No. | Hydrophilic solvent Dipole moment Boiling point | Parts by mass | Hydrophobic solvent Dipole moment Boiling point | Parts by mass | Other solvent Dipole moment Boiling point | Parts by mass | Polymer compound No. of Table C | Parts by mass | Remarks Coating environment Standing time, etc. |
|---|---|---|---|---|---|---|---|---|---|
| Com. Ex. 3 | — — | — | Chlorobenzene 0.953 [D] 131.7 [° C.] | 58.8 | — — | — | Polyarylate resin C-1 | 5.9 | 23° C. 50% RH For 3 min No depressed portion |
| Com. Ex. 4 | — — | — | Chlorobenzene 0.953 [D] 131.7 [° C.] | 58.8 | — — | — | Polycarbonate resin C-2 | 11.8 | 23° C. 50% RH For 3 min No depressed portion |
| Com. Ex. 5 | Tetrahydrofuran 1.7 [D] 66 [° C.] | 29.4 | Chlorobenzene 0.953 [D] 131.7 [° C.] | 29.4 | — — | — | Polyarylate resin C-1 | 5.9 | 23° C. 50% RH For 3 min No depressed portion |
| Com. Ex. 6 | Tetrahydrofuran 1.7 [D] 66 [° C.] | 29.4 | Chlorobenzene 0.953 [D] 131.7 [° C.] | 29.4 | — — | — | Polycarbonate resin C-2 | 11.8 | 23° C. 50% RH For 3 min No depressed portion |
| Com. Ex. 7 | — — | — | Methylbenzene 0.261 [D] 110.6 [° C.] | 58.8 | — — | — | Polyarylate resin C-3 | 5.9 | 23° C. 50% RH For 3 min No depressed portion |
| Com. Ex. 8 | — — | — | Methylbenzene 0.261 [D] 110.6 [° C.] | 58.8 | — — | — | Polycarbonate resin C-2 | 11.8 | 23° C. 50% RH For 3 min No depressed portion |
| Com. Ex. 9 | — — | — | Xylene 0.24 [D] 139 [° C.] | 58.8 | — — | — | Polyarylate resin C-3 | 5.9 | 23° C. 50% RH For 3 min No depressed portion |
| Com. Ex. 10 | — — | — | Xylene 0.24 [D] 139 [° C.] | 58.8 | — — | — | Polycarbonate resin C-2 | 11.8 | 23° C. 50% RH For 3 min No depressed portion |

As is clear from the above results, according to the preparing method of the present invention, electrophotographic photosensitive members having various depressed portions can be manufactured in high productivity and stably depending on kinds and amounts of hydrophilic solvents. Therefore, an electrophotographic photosensitive member having a surface shape corresponding to functions required for a surface layer can be provided.

The present application claims the priority of Japanese Patent Application No. 2007-185406, filed on Jul. 17, 2007, the subject of which is part of the present application herein by reference.

What is claimed is:

1. A method for preparing an electrophotographic photosensitive member having depressed portions on a surface thereof, wherein a coating liquid for a surface layer which comprises a solvent comprising a hydrophilic solvent and a hydrophobic solvent and a polymer compound soluble in the hydrophobic solvent is used; the hydrophilic solvent has a boiling point equal to or higher than that of the hydrophobic solvent; the hydrophilic solvent has a dipole moment of 0 or more and less than 2.8, obtained by a structure optimized calculation using a semiempirical molecular orbital calculation; the total mass of the hydrophobic solvent is 50 mass % or more and less than 100 mass % of the total mass of the solvent comprised in the coating liquid for a surface layer; and after the coating liquid for a surface layer is applied, the depressed portions are formed by condensation on the surface on which the coating liquid for a surface layer is applied.

2. The method for preparing an electrophotographic photosensitive member according to claim 1, wherein the hydrophobic solvent has a dipole moment of 0 or more and 1.0 or less, obtained by the structure optimized calculation using the semiempirical molecular orbital calculation.

3. The method for preparing an electrophotographic photosensitive member according to claim 1, wherein the hydrophobic solvent has a boiling point equal to or higher than 100° C.

4. The method for preparing an electrophotographic photosensitive member according to claim 1, wherein the hydrophobic solvent is an aromatic organic solvent.

5. The method for preparing an electrophotographic photosensitive member according to claim 1, wherein the polymer compound soluble in the hydrophobic solvent is either one or both of a polycarbonate resin and an aromatic polyester resin.

6. The method for preparing an electrophotographic photosensitive member according to claim 1, wherein the hydrophobic solvent is at least one solvent selected from the group consisting of methylbenzene, ethylbenzene, 1,2-dimethylbenzene, 1,3-dimethylbenzene, 1,4-dimethylbenzene, 1,3,5 -trimethylbenzene and chlorobenzene.

7. The method for preparing an electrophotographic photosensitive member according to claim 1, wherein the hydrophilic solvent is a compound comprising at least one of at least one kind of functional groups selected from the group consisting of a carbonyl group, a hydroxyl group and an amide group.

8. The method for preparing an electrophotographic photosensitive member according to claim 1, wherein the hydrophilic solvent is a compound comprising at least two hydroxyl groups, two amide groups or a hydroxyl group and an amide group.

9. The method for preparing an electrophotographic photosensitive member according to claim 1, wherein the hydrophilic solvent is a polymer comprising either one or both of a hydroxyl group and an amide group as a repeating unit.

10. The method for preparing an electrophotographic photosensitive member according to claim 1, wherein the hydrophilic solvent is at least one solvent selected from the group consisting of diethylene glycol diethyl ether, N,N,N',N'-tetramethylurea, 2-ethoxyethanol, 2-(methoxymethoxy) ethanol, 2-butoxyethanol, tetrahydrofurfuryl alcohol, diethylene glycol monomethyl ether, diethylene glycol monoethyl ether, triethylene glycol, polyethylene glycol and N,N,N',N'-tetramethylethylenediamine.

* * * * *